US005634524A

United States Patent [19]

Campbell

[11] Patent Number: 5,634,524

[45] Date of Patent: Jun. 3, 1997

[54] REVERSE PERCUSSION DEVICE

[75] Inventor: Paul Campbell, Roanoke, Va.

[73] Assignee: Reedrill Corporation, Denison, Tex.

[21] Appl. No.: 436,709

[22] Filed: May 8, 1995

Related U.S. Application Data

[63] Continuation of Ser. No. 242,195, May 13, 1994, Pat. No. 5,413,186.

[51] Int. Cl.[6] ..... E21B 4/14

[52] U.S. Cl. ..... 175/296; 175/135

[58] Field of Search ..... 175/92, 135, 243, 175/296

[56] References Cited

U.S. PATENT DOCUMENTS 5,002,136 3/1991 Barthomeuf .
5,022,309 6/1991 Campbell .
5,320,189 6/1994 Rodert et al. ..... 175/296
5,413,186 5/1995 Campbell .

*Primary Examiner*—Frank Tsay
*Attorney, Agent, or Firm*—David H. Judson

[57] ABSTRACT

A reverse percussion device for use with hydraulic percussive drills is provided. The reverse percussion device includes a cycling piston, valve and anvil. The piston and valve move in opposing directions between low and high pressure passages automatically until a lodged drill bit is freed, thereby facilitating removal of the drill bit from the drilled hole and eliminating alternate loosening and tightening of drill string threads. The reverse percussion device preferably includes an automatic disabling feature which causes the reverse percussion operation to cease when the bit is free to retract normally.

1 Claim, 5 Drawing Sheets

REVERSE PERCUSSION DEVICE

This is a continuation of Ser. No. 8/242,195 filed May 13, 1994 now U.S. Pat. No. 5,413,186.

TECHNICAL FIELD

The present invention relates generally to drilling equipment and more particularly to a reverse percussion device for a hydraulic percussive drill which allows the benefits of reverse percussion operation during difficult drilling conditions but eliminates the adverse effect on component life normally associated with such operation.

BACKGROUND OF THE INVENTION

A typical blasthole drilling system includes a drill carrier or "trackdrill", an impacting device or "drifter", a drill string comprising a drill steel and couplings, and a bit. The blasthole drilling operation forms holes in a rock formation which are subsequently filled with an explosive material and detonated to fracture the rock into small pieces which can subsequently be removed.

The holes are usually drilled in a specific grid pattern. Certain circumstances, however, may cause the bit to become lodged or stuck in the hole. For instance, shifting of loose material in the hole, failure to adequately flush drilled material out of the hole, or debris falling into the hole often result in the bit becoming stuck in the hole. In these cases, the bit cannot be easily extracted. Consequently, time is lost in attempting to remove the lodged bit from the hole. In some cases, the bit and steel become lodged to the extent that removal is impractical or impossible. In these cases, the bit and steel are often left in the hole and a new hole drilled adjacent to the original hole, thereby resulting in the loss of both time and equipment.

Reverse percussion devices, which create a percussive force in a direction opposite to the percussive force generated during normal drilling, are known in the prior art. When a reverse percussion device is added to a drifter, recovery of a lodged bit and steel is facilitated by superimposing an upward repetitive impacting force on the steady upward force exerted by the feed system.

In particular, conventional reverse percussion devices operate on the principle that the reverse percussion piston, when idle, rests in a downward position. The piston is held in position by seal friction against the influence of any residual pressure or system back pressure in the reverse percussion chamber. When the operator perceives a need for reverse percussion activation, a manual control valve connects supply pressure to the reverse percussion chamber. The reverse percussion piston forces a shank adapter into the normal drilling impact position, holding the shank adapter in position with supply pressure. The drifter piston then strikes the shank adapter normally, causing the reverse percussion piston to move downward slightly in response to the impact and then return quickly to its upward position. A slight impact is created against the shank adapter collar by this action and the impact assists in retracting the stuck drill string.

When the need for the reverse percussion no longer exists, the manual control valve vents the reverse percussion chamber to a tank and the reverse percussion piston is allowed to return to its downward position, pushed by the shank adapter collar while retracting the drill string from the hole.

More particularly, known devices function by hydraulically forcing a shank adapter upward into its normal drilling position, during retraction of the bit from the hole, and causing the drifter piston to cycle normally. The shank adapter is repeatedly struck and forced downward by the drifter piston and then abruptly returned into position by the constant hydraulic force against the reverse percussion piston. This motion tends to loosen the stuck bit. However, wear on the drill string components is accelerated because the drill string connecting threads are alternately tightened and loosened with each impact cycle. In addition, these devices are subject to abuse when left operating even when the bit is not being struck. Under this condition, all energy generated by the reverse percussion operation must be dissipated in the drill string, which further aggravates the wear problem on component parts.

Such prior art reverse percussion devices, however, are somewhat destructive to drilling equipment. This is due in part to the fact that the full drifter piston energy is delivered to the drill string, but very little of the energy is actually used. Another disadvantage associated with the prior art is that such devices are subject to operator abuse since manual control allows the reverse percussion device to be activated when it is not actually necessary, thereby accelerating damage to equipment and system components.

Additionally, conventional reverse percussion devices are often sensitive to system backpressure. This is attributable to the dependence upon seal friction alone to prevent activation of the reverse percussion device under the influence of backpressure. Because the accumulator must operate over a very large pressure range from system backpressure to large pressure spikes generated by the drifter piston impact, accumulator life tends to be short. Yet another disadvantage associated with the prior art is the requirement for additional control valve components in the hydraulic system.

It would therefore be desirable to provide a reverse percussion device which overcomes the problems associated with the prior art. In particular, it would be desirable to provide a reverse percussion device having a cycling piston which eliminates wear and tear of equipment, which eliminates operator abuse and enhances the efficiency obtained from reverse percussion devices of the prior art.

BRIEF SUMMARY OF THE INVENTION

It is an object of the present invention to provide a reverse percussion device which functions automatically such that manual or operator initiation is unnecessary.

It is another object of the present invention to provide a reverse percussion device which includes a cycling piston to eliminate the necessity for alternate loosening and tightening of drill string threads.

Still another object of the present invention is to provide a reverse percussion device which reduces the wear and tear on equipment due to repetitive impact.

Yet another object of the present invention is to provide a reverse percussion device which enhances the efficiency of withdrawing a lodged bit from a drilled hole.

A still further object of the present invention is to provide a reverse percussion device which reduces the loss of drilling equipment due to lodged drill bits which must be left in drilled holes.

These and other objects of the invention are provided in a reverse percussion device which utilizes its own cycling piston, thereby eliminating the drifter piston from the reverse percussion operation and eliminating the alternate loosening and tightening of drill string threads. Preferably, the reverse percussion device includes an automatic disabling feature which causes the reverse percussion operation to cease when the drill bit is free to retract normally.

In one embodiment, the reverse percussive device includes a housing having first and second chambers extending along a longitudinal axis of a hydraulic percussive drill. The first chamber has a pair of opposed facing edges. An anvil is also disposed within the first chamber of the housing and positioned to move between first and second control positions along the longitudinal axis between the pair of opposed facing edges. A piston having a bore therethrough for receiving an elongated shank adapter is disposed in the second chamber of the housing and positioned to move along the longitudinal axis. A valve is positioned to move between first and second control positions along the longitudinal axis and is adapted to control the movement of the piston within the housing. Fluid pressure is controlled and cooperates with the valve (a) for maintaining the piston in a stalled position during a first mode of operation in which the anvil is in the first control position within the first chamber, (b) for cyclically-reciprocating the piston within the second chamber during a second mode of operation corresponding to movement of the anvil from the first control position to the second control position within the first chamber, and (c) for returning the piston back to its stalled position following the second mode of operation corresponding to movement of the anvil from the second control position back to the first control position.

The foregoing has outlined some of the more pertinent objects of the present invention. These objects should be construed to be merely illustrative of some of the more prominent features and applications of the invention. Many other beneficial results can be attained by applying the disclosed invention in a different manner or modifying the invention as will be described. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which.

Similar reference characters refer to similar parts throughout the several views of the drawings.

DETAILED DESCRIPTION

Figure 1:
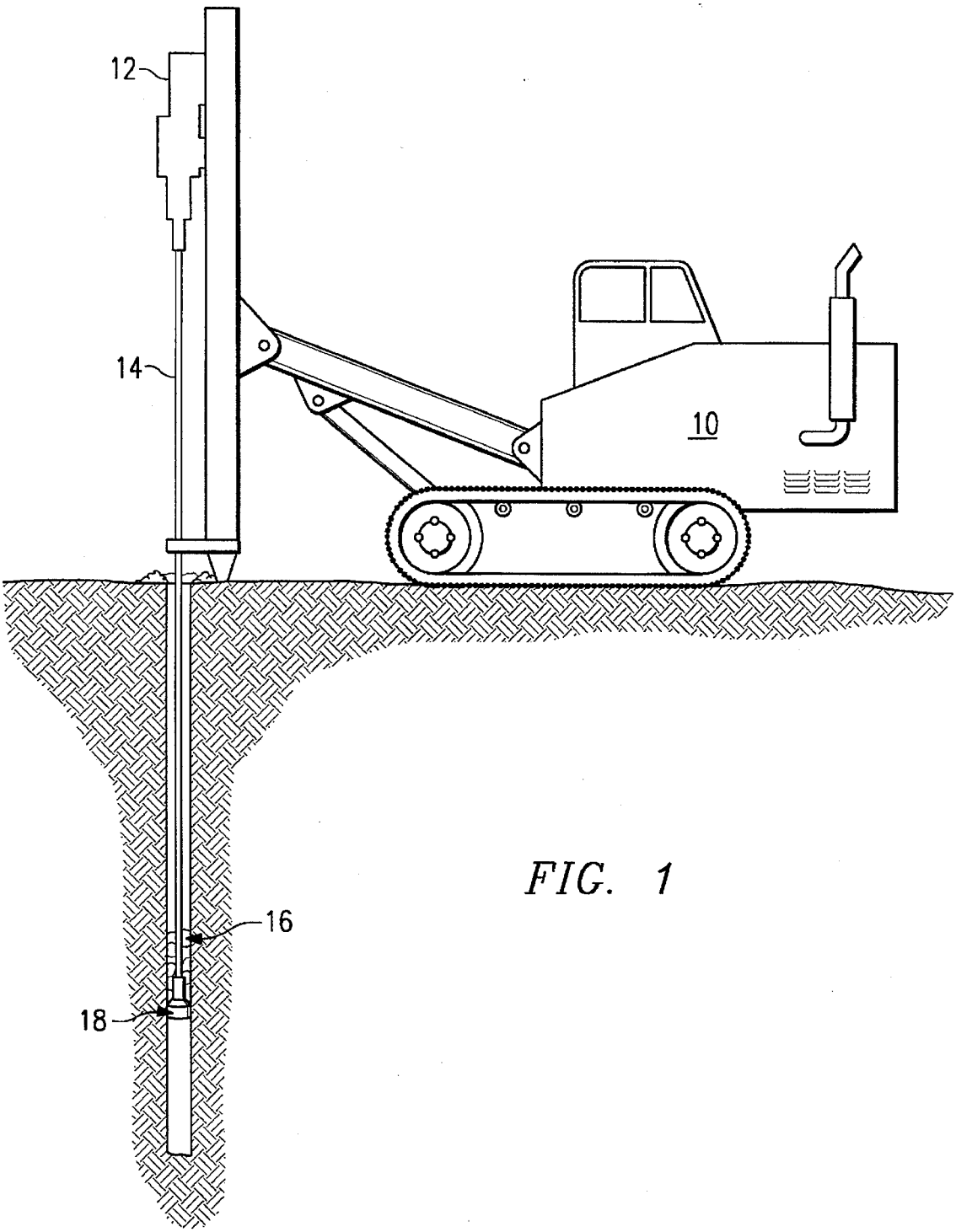
FIG. 1 is illustrates a blasthole drilling system in which a drill bit has become lodged in a drilled hole.

Referring now to FIG. 1, a blasthole drilling system is shown. The system includes trackdrill or drill carrier 10, drifter or impacting device 12, drill string 14 and bit 18. During drilling operations, bit 18 often becomes lodged in the drilled hole due to debris 16 or the like. It therefore becomes necessary to loosen or dislodge bit 18 such that it may be pulled through debris 16 and removed from the drilled hole.

Figure 2:
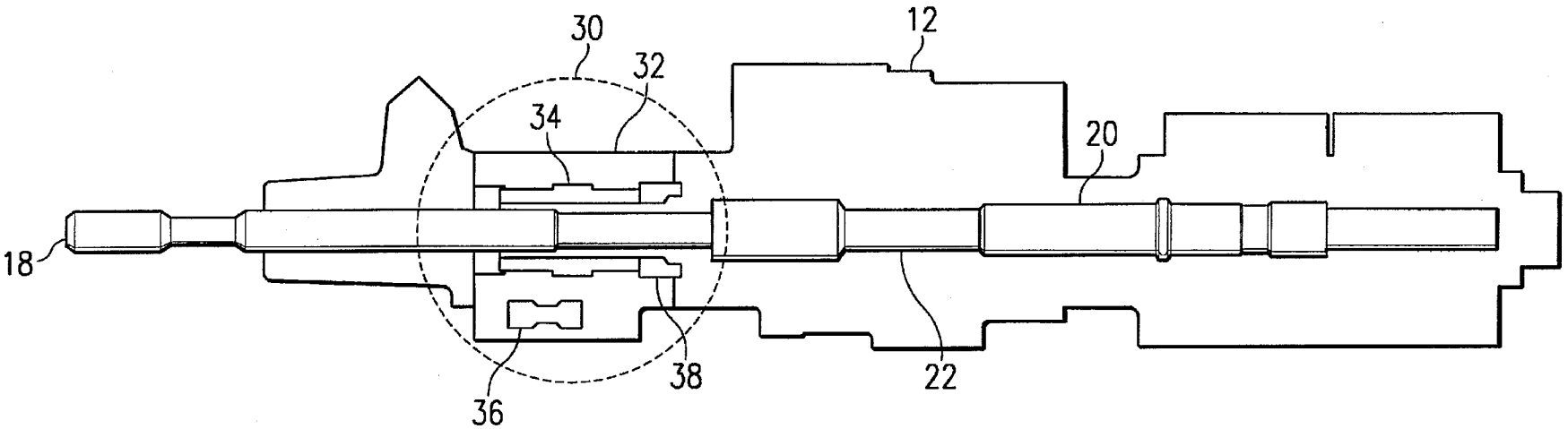
FIG. 2 is a cross-sectional view of a drifter, shank adapter and reverse percussion device in accordance with the present invention.

The reverse percussion device 30 in accordance with the present invention is shown in FIGS. 2–5, with device 30 incorporated into impacting device 12. FIG. 2 thus illustrates the novel reverse percussion device in relation to other system components in accordance with the present invention. As shown in FIG. 2, drifter 12 includes an elongated shank adapter 22 extending longitudinally therethrough. A drifter piston 20 strikes the shank adapter 22 at one end; an opposite end of the adapter attaches to the drill string. The reverse percussion device 30 includes a housing 32 in which piston 34, valve 36 and reverse percussion anvil 38 are positioned. Housing 32 includes first and second chambers, 76 and 78, respectively, extending along the longitudinal axis. First chamber 76 has a pair of opposed facing edges 58 and 56.

In a preferred embodiment, reverse percussive device 30 includes housing 32 having first chamber 76 and second chamber 78 extending along a longitudinal axis of a hydraulic percussive drill. As mentioned above, first chamber 76 has a pair of opposed facing edges 58 and 56. Anvil 38 is also disposed within first chamber 76 of housing 32 and positioned to move between first and second control positions along the longitudinal axis between edges 58 and 56. Piston 34, which is disposed in second chamber 78 of housing 32 and positioned to move along the longitudinal axis, has a bore therethrough for receiving elongated shank adapter 22. Valve 36 is positioned to move between first and second control positions and is adapted to control the movement of piston 34 within housing 32.

Figure 3:
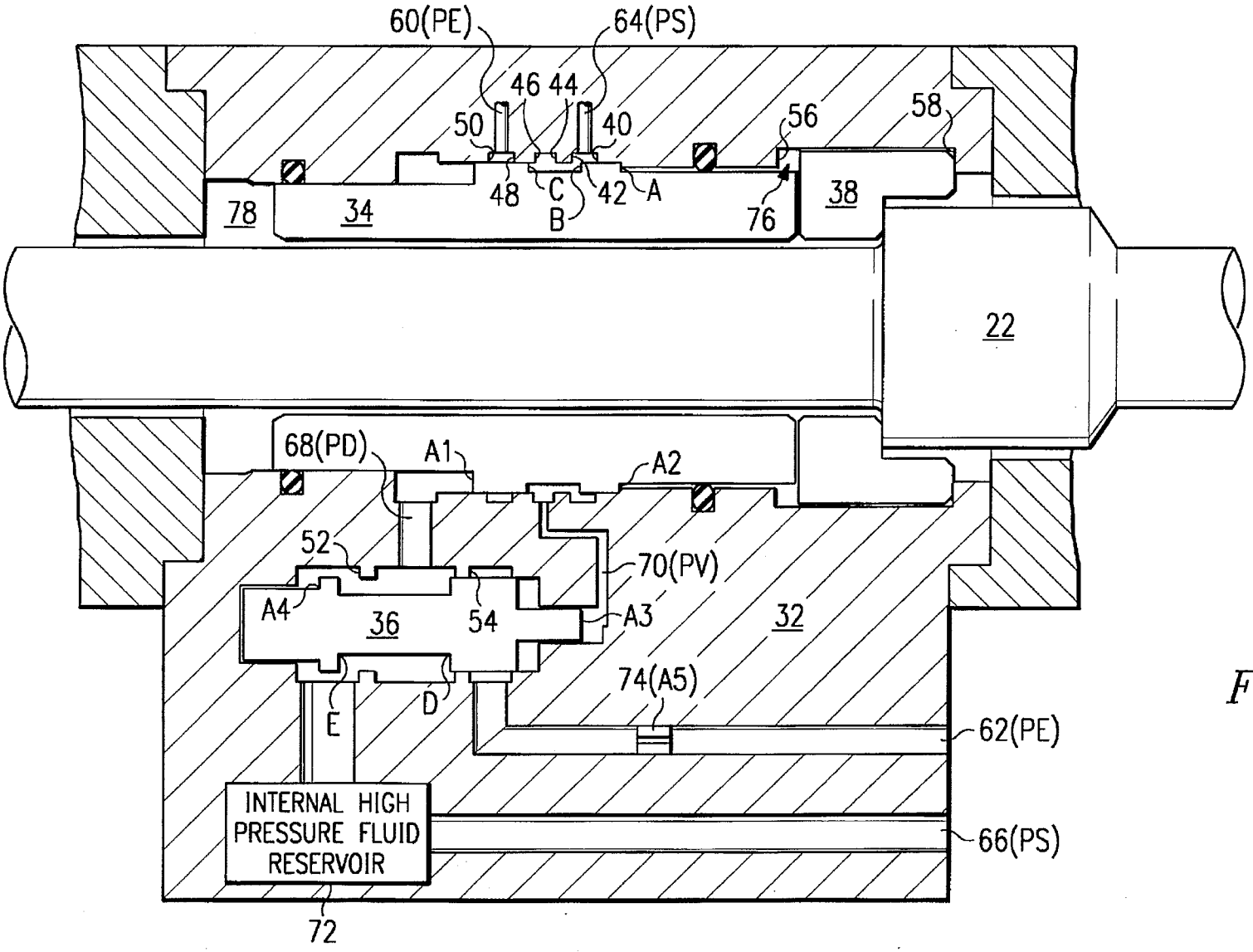
FIG. 3 is an exploded cross-sectional view of the reverse percussion device illustrated in FIG. 2 in which the device is at rest.
Figure 4:
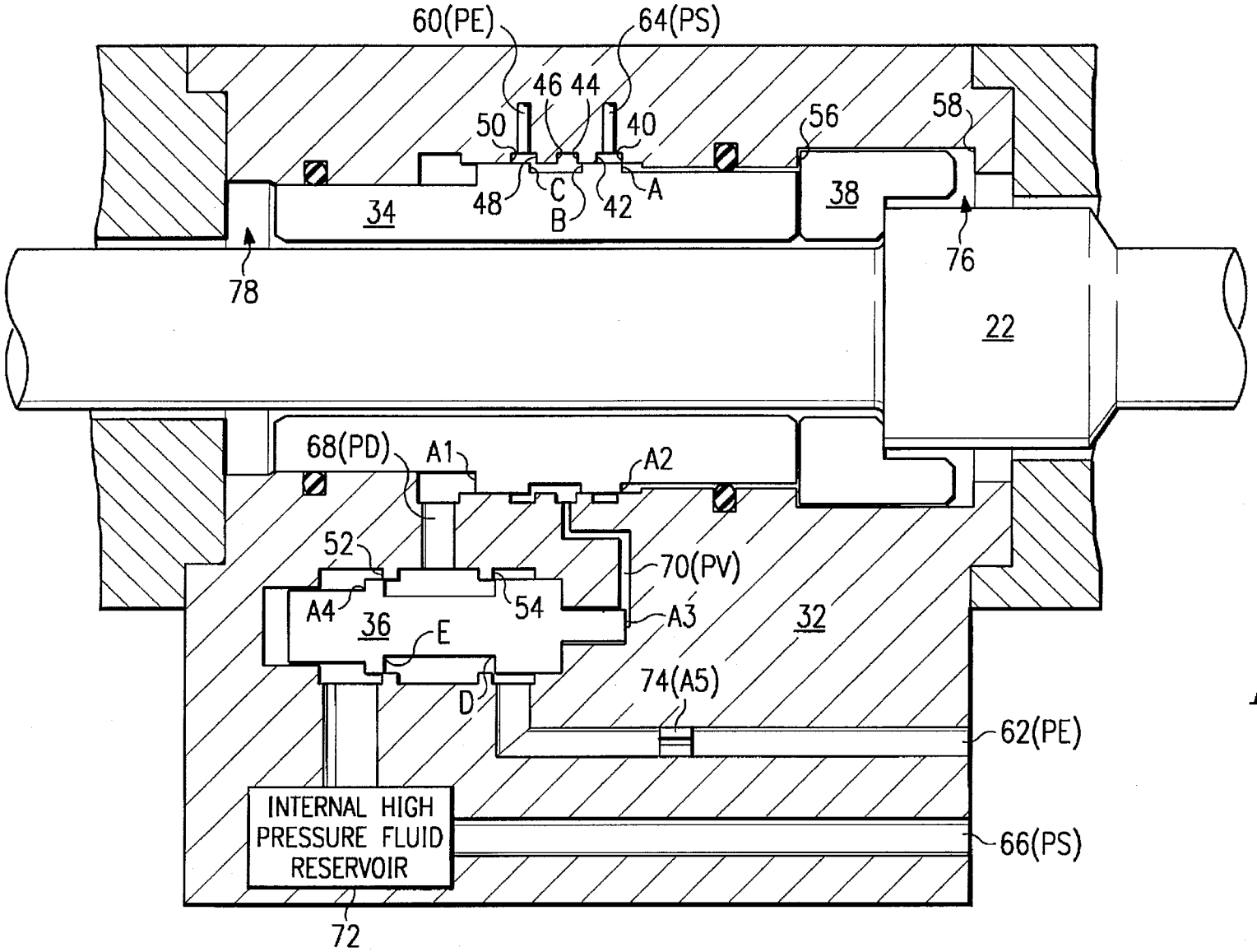
FIG. 4 is an exploded cross-sectional view of the reverse percussion device shown in FIG. 2 in which the device is activated.
Figure 5:
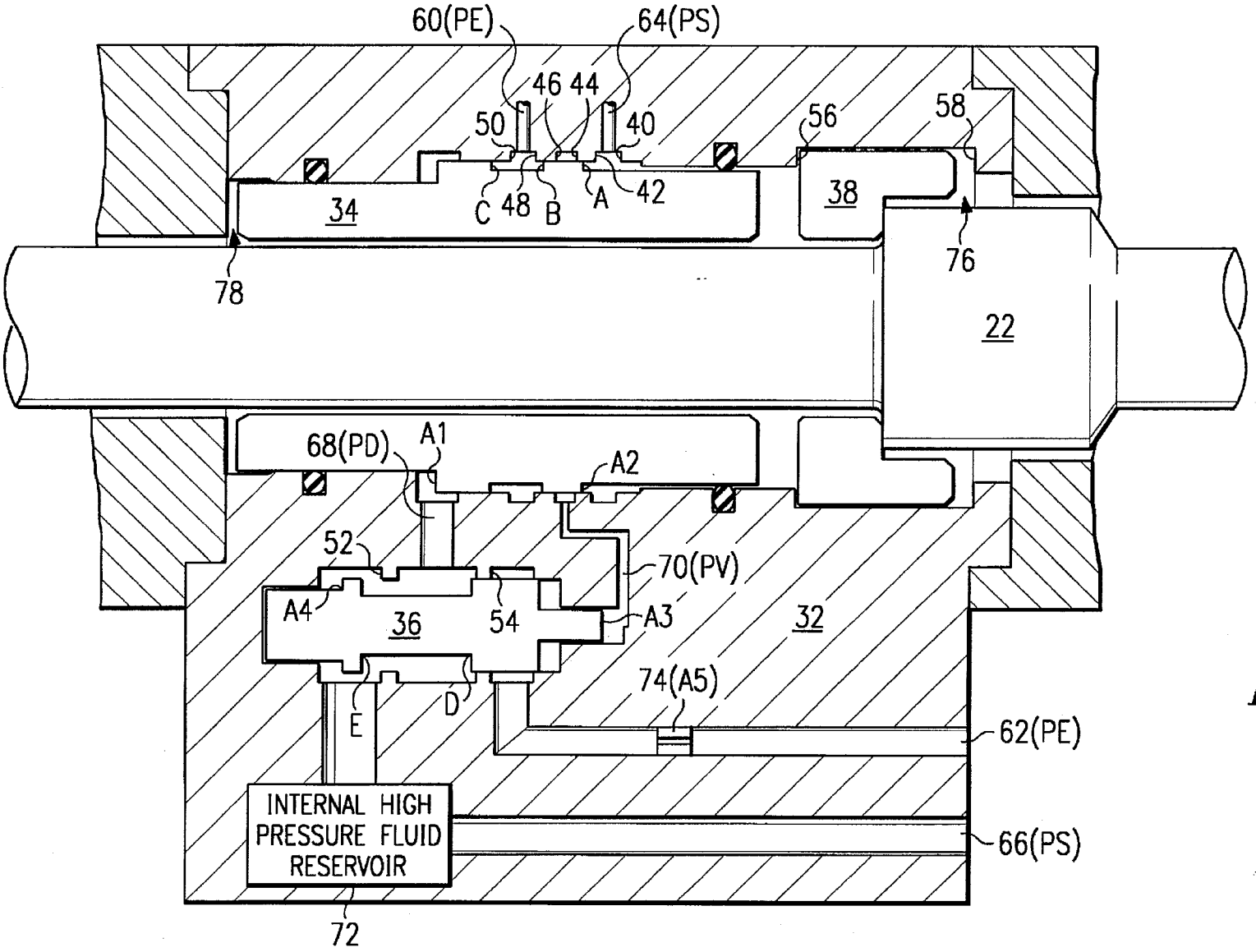
FIG. 5 is an exploded cross-sectional view of the reverse percussion device shown in FIG. 2 in which the device has been activated and the piston is forced in a direction opposite the shoulder of the shank adapter.

Reference is now had to FIGS. 3–5. FIG. 3 illustrates the reverse percussion device 30 of FIG. 2 in accordance with the invention during a first mode of operation in which piston 34 of the device 30 is at rest or "stalled". As discussed in more detail herein, FIGS. 4–5 show the positioning of the various components of the device 30 when the anvil 38 has moved to its second position, thereby initiating a second mode of operation wherein the piston 34 cyclically-reciprocates between first and second positions.

A more detailed description of the operation of the reverse percussion device in accordance with the present invention will now be described with reference to FIGS. 3–5, collectively. Passages 64 and 66 are at a constant high pressure (PS), connected to a source of high pressure fluid through an internal high pressure fluid reservoir 72 or alternatively, a high pressure accumulator. Passages 60 and 62 are at a constant low pressure (PE), connected to an external fluid reservoir or tank. While not meant to be limiting, passages 64 and 66 operate at pressure in the range of approximately 2000–3000 psi and preferably at about 2500 psi while passages 60 and 62 operate at pressures in the range of about 50–200 psi and preferably at about 150 psi. Pressure in passage 68 (PD) and pressure in passage 70 (PV) vary between PS and PE during the cyclic operation. The motion of piston 34 is controlled by pressures PD and PS against areas A1 and A2, respectively. The motion of valve 36 is controlled by pressures PV and PS against areas A3 and A4, respectively. It should be appreciated that the area of A1 is greater than A2 and the area of A3 is greater than A4.

Pressure PV in passage 70 is controlled by the position of piston 34, which determines whether the annular area established by edges 44 and 46 is connected to the annular area established by edges 40 and 42 or the annular area established by edges 48 and 50. Pressure PD in passage 68 is controlled by the position of valve 36, which determines whether passage 68 is connected to a flow passage created by edge 52 or a flow passage created by edge 54.

When the reverse percussion device is at rest as shown in FIG. 3, pressures PD in passage 68 and PV in passage 70 are both connected to PS. Additionally, piston 34 and valve 36 are stalled. The differential pressures acting on areas A1 and A2 with area A1 being greater than that of A2 hold piston 34 firmly to the right, thereby forcing anvil 38 against face 58 in first chamber 76 of housing 32. Motion does not occur under the influence of any fluid forces until anvil 38 is mechanically forced away from face 58 and against opposed face 56 in first chamber 76, as shown in FIG. 4. When bit 18 is being retracted from the hole, anvil 38 acts as a retainer for shank adapter 22, transferring the retracting force through anvil 38 and piston 34 into the hydraulic fluid.

The geometry of areas A1 and A2 is such that the net fluid force holding the anvil against face 58 will be greater than the normal retracting forces. If the retracting force exceeds the net fluid force holding anvil 38 against face 58, such as when the bit becomes stuck or jammed, anvil 38 is forced against face 56 and the reverse percussion device 30 begins operation automatically. As further illustrated in FIG. 4, edge B on piston 34, which is positioned and moves within second chamber 78 of housing 32, closes off edge 42, and edge C on piston 34 has uncovered edge 48. This action in turn causes pressure PV in passage 70 to be connected to pressure PE rather than PS, thereby forcing valve 36 to the right and thus connecting pressure PD in passage 68 to PE instead of PS. Once these pressure switches have occurred, reverse percussion device 30 begins a normal cyclic operation. The net fluid force on piston 34 is toward the left, and piston 34 accordingly begins to move in that direction within second chamber 78 as shown in FIGS. 4 and 5. As the piston moves to the left, fluid is pushed by area A1 through passage 68 and the valve 36 into passage 62, which is connected to an external low pressure fluid reservoir. The fluid preferably passes through a control orifice 74 contained in passage 62, which regulates the speed of the piston retracting stroke. The area A5 of the orifice 74 has a relationship to A1, and is approximately 1–5% of A1.

As the piston continues to move to the left on its retract stroke as illustrated in FIG. 5, pushing fluid out through control orifice 74, edge B closes off edge 46 and edge A then uncovers edge 44. This connects pressure PV in passage 70 to PS and valve 36 moves to the left again. When edge D has closed off edge 54 and edge E has uncovered edge 52, pressure PD in passage 68 will be connected to PS and the drive stroke will be initiated. Piston 34 and valve 36 positions at this time are shown in FIG. 5.

As piston 34 moves to the right on its own stroke, edge A closes off edge 44 and edge B then uncovers edge 46, connecting pressure PV once again to PE and causing valve 36 to move again to the right as shown in FIG. 4. The timing of this motion is such that edge D uncovers edge 54 just after piston 34 impacts anvil 38, and piston 34 begins a new cycle. The energy of the impact against anvil 38 is transmitted into the shoulder of shank adapter 22, through the drill steel and bit 18, and into the rock fragments or other debris 16 which are causing bit 18 to be jammed. This energy causes debris 16 to be broken up and dispersed, thereby allowing bit 18 to be freely retracted from the drilled hole.

As long as bit 18 is encountering sufficient resistance to hold anvil 38 against face 56, piston 34 will continue its repetitive striking of anvil 38. However, when bit 18 is freed and anvil 38 is driven back against face 58 by the upward force of piston 34, edge C again closes off edge 48 and edge B uncovers edge 42. This causes valve 36 to move back to the left as illustrated in FIG. 3, maintaining pressure PD in passage 68 connected to PS and holding piston 34 in the rest position, as shown in FIG. 3.

In contrast to the prior art, the piston 34 of the reverse percussion device 30 is held upward against anvil 38 by supply pressure in the stalled condition as illustrated in FIG. 3. When the downward force exerted by a shank adapter against anvil 38 exceeds the upward force on piston 34 (indicating a stuck drill string 14), piston 34 moves into its normal impacting position and begins to impact on anvil 38. The impact energy is transmitted through anvil 38 into the shank adapter face. It should be appreciated that drifter piston 20 has no function in the reverse percussion operation and whether the drifter piston 20 cycles or not is thus immaterial.

When the lodged bit is freed, the downward force exerted on anvil 38 by the shank adapter collar fails, and anvil 38 is pushed into its upward or idle position by piston 34. Piston 34 stalls in this position. While not required, an alternative embodiment of the invention includes a pilot-operated check valve in the exhaust line to limit internal leakage while in the stalled condition.

The reverse percussion device of the present invention thus provides automatic operation, thereby eliminating operator abuse. The reverse percussion device is completely self-contained with the exception of hose connections. No external control valves are required with the device of the present invention. Additionally, the reverse percussion devices do not "rattle" the drill string in operation, so that accessory life is improved. Moreover, these devices use low energy consumption and delivery. Another advantage of the present invention is that accumulators do not fail or require maintenance.

It should be appreciated by those skilled in the art that the specific embodiments disclosed above may be readily utilized as a basis for modifying or designing other structures for carrying out the same purposes of the present invention. It should also be realized by those skilled in the art that such equivalent constructions do not depart from the spirit and scope of the invention as set forth in the appended claims.

What is claimed is:

1. A device for use with a hydraulic percussive drill having an adapter extending through the drill along a longitudinal axis, the device comprising:

a piston having a bore therethrough for receiving the adapter, the piston positioned to reciprocate along the longitudinal axis;

an actuator positioned to move between first and second control positions along the longitudinal axis;

fluid pressure control means, (a) for maintaining the piston in a stalled position during a first mode of operation corresponding to the actuator being located in the first control position, (b) for cyclically-reciprocating the piston along the longitudinal axis during a second mode of operation corresponding to movement of the actuator from the first control position to the second control position, and (c) for returning the piston back to its stalled position following the second mode of operation corresponding to movement of the actuator from the second control position back to the first control position.

* * * * *